US010113357B2

(12) United States Patent
Gillen et al.

(10) Patent No.: US 10,113,357 B2
(45) Date of Patent: Oct. 30, 2018

(54) DOOR ASSEMBLY

(71) Applicant: Therma-Tru Corp., Maumee, OH (US)

(72) Inventors: Seth R. Gillen, Hamilton, IN (US); Jarrod Buffy, Waterville, OH (US)

(73) Assignee: THERMA-TRU CORPORATION, Maumee, OH (US)

( * ) Notice: Subject to any disclaimer, the term of this patent is extended or adjusted under 35 U.S.C. 154(b) by 0 days.

(21) Appl. No.: 14/995,445

(22) Filed: Jan. 14, 2016

(65) Prior Publication Data

US 2016/0208529 A1 Jul. 21, 2016

Related U.S. Application Data

(60) Provisional application No. 62/104,161, filed on Jan. 16, 2015, provisional application No. 62/219,935, filed on Sep. 17, 2015.

(51) Int. Cl.

| | |
|---|---|
| ***E06B 7/23*** | (2006.01) |
| ***E05D 3/02*** | (2006.01) |
| ***E05F 1/06*** | (2006.01) |
| ***E06B 1/04*** | (2006.01) |
| ***E06B 1/70*** | (2006.01) |
| *E06B 3/36* | (2006.01) |
| *E05F 1/10* | (2006.01) |

(52) U.S. Cl.

CPC ..... *E06B 7/2316* (2013.01); *E05D 3/022* (2013.01); *E05F 1/063* (2013.01); *E06B 1/045* (2013.01); *E06B 1/70* (2013.01); *E06B 7/231* (2013.01); *E06B 7/2312* (2013.01); *E05F 1/1025* (2013.01); *E05Y 2201/474* (2013.01); *E05Y 2800/12* (2013.01); *E05Y 2900/132* (2013.01); *E06B 3/36* (2013.01); *E06B 7/2314* (2013.01); *E06B 2001/707* (2013.01)

(58) Field of Classification Search

CPC . Y10T 16/539; Y10T 16/53985; E05D 3/022; E05F 1/063; E06B 1/70; E06B 1/006

USPC ..... 49/470, 468, 467, 469, 475.1, 236, 239, 49/483.1, 479.1

See application file for complete search history.

(56) References Cited

U.S. PATENT DOCUMENTS

| | | | | |
|---|---|---|---|---|
| 749,379 | A * | 1/1904 | Hartman | E05F 1/063 16/318 |
| 887,249 | A * | 5/1908 | Hall | E06B 7/2316 280/153.5 |
| 2,872,714 | A * | 2/1959 | Odegaard | E06B 1/70 49/469 |

(Continued)

*Primary Examiner* — Marcus Menezes

(74) *Attorney, Agent, or Firm* — Calfee, Halter & Griswold LLP

(57) ABSTRACT

A door assembly with improved sealing between the door and door frame. The door assembly may include a door frame having a first side section and a sill section, a door including a first edge surface and a second edge surface and a hinge having a first portion connected to the first side section and a second portion connected to the first edge surface to pivotably connect the door to the door frame such that the door is pivotable between an open position and a closed position, wherein the hinge moves the second edge surface vertically downward toward the sill section only during the last 50 degrees of pivotal movement of the door from the open position to the closed position.

10 Claims, 13 Drawing Sheets

(56) References Cited

U.S. PATENT DOCUMENTS

| | | | | | |
|---|---|---|---|---|---|
| 2,935,771 | A * | 5/1960 | Hatcher, Jr. | E06B 7/2309 | 49/489.1 |
| 3,083,402 | A * | 4/1963 | Foltz | E05F 1/063 | 16/318 |
| 3,398,487 | A * | 8/1968 | Matyas | E05F 1/063 | 16/312 |
| 3,546,736 | A * | 12/1970 | Booth | E05F 1/063 | 16/312 |
| 4,607,457 | A * | 8/1986 | Shewchuk | E06B 7/2301 | 49/400 |
| 4,656,785 | A * | 4/1987 | Yackiw | E06B 7/2312 | 49/489.1 |
| 4,831,779 | A * | 5/1989 | Kehrli | E06B 1/70 | 49/380 |
| 5,045,636 | A * | 9/1991 | Johnasen | C07K 14/811 | 174/375 |
| 5,095,658 | A * | 3/1992 | Anderhalden | E06B 7/2309 | 49/479.1 |
| 5,174,065 | A * | 12/1992 | Schlicht | E06B 7/2312 | 49/470 |
| 5,371,987 | A * | 12/1994 | Hirsch | E06B 1/045 | 49/239 |
| 5,943,825 | A * | 8/1999 | Procton | E06B 1/70 | 49/469 |
| 6,938,665 | B2 * | 9/2005 | Lewis, Jr. | E05D 3/04 | 16/365 |
| 2005/0011046 | A1 * | 1/2005 | Dionysian | E05F 1/063 | 16/316 |

* cited by examiner 230
232
234
236
240
242
244
246
250
252
253
254
260
262
264
266
270
272
274
276
280

DOOR ASSEMBLY

CROSS-REFERENCE TO RELATED APPLICATIONS

This application claims the benefit of U.S. Provisional Application No. 62/104,161, filed Jan. 16, 2015, and U.S. Provisional Application No. 62/219,935, filed Sep. 17, 2015, which are herein incorporated by reference in their entirety.

FIELD OF INVENTION

The present invention relates generally to the field of door assemblies, and more particularly, to door assemblies with improved sealing between the door and the door frame.

BACKGROUND

Doors have been used for centuries to provide and deny access through openings and passageways. A common arrangement is for a door to be pivotably mounted in a door frame by hinges. The door may be provided with a door seal, such as for example weather stripping, for providing a seal between the bottom of the door and the sill. It is desirable to provide a door assembly with sufficient sealing when the door is closed while also allowing the door to be open and closed easily.

SUMMARY

The present patent application discloses exemplary embodiments of door assemblies. In an exemplary embodiment, the door assembly includes a door frame having a first side section and a sill section, a door including a first edge surface and a second edge surface and a hinge having a first portion connected to the first side section and a second portion connected to the first edge surface to pivotably connect the door to the door frame such that the door is pivotable between an open position and a closed position, wherein the hinge moves the second edge surface vertically downward toward the sill section only during the last 50 degrees of pivotal movement of the door from the open position to the closed position.

BRIEF DESCRIPTION OF THE SEVERAL VIEWS OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION

The embodiments disclosed herein will now be described by reference to some more detailed embodiments, in view of the accompanying drawings. These embodiments may, however, be embodied in different forms and should not be construed as limited to the embodiments set forth herein.

Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which these embodiments belong. The terminology used in the description herein is for describing particular embodiments only and is not intended to be limiting of the embodiments. As used in the specification and the appended claims, the singular forms "a," "an," and "the" are intended to include the plural forms as well, unless the context clearly indicates otherwise. All publications, patent applications, patents, and other references mentioned herein are incorporated by reference in their entirety.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Every numerical range given throughout this specification and claims will include every narrower numerical range that falls within such broader numerical range, as if such narrower numerical ranges were all expressly written herein.

Figure 1:
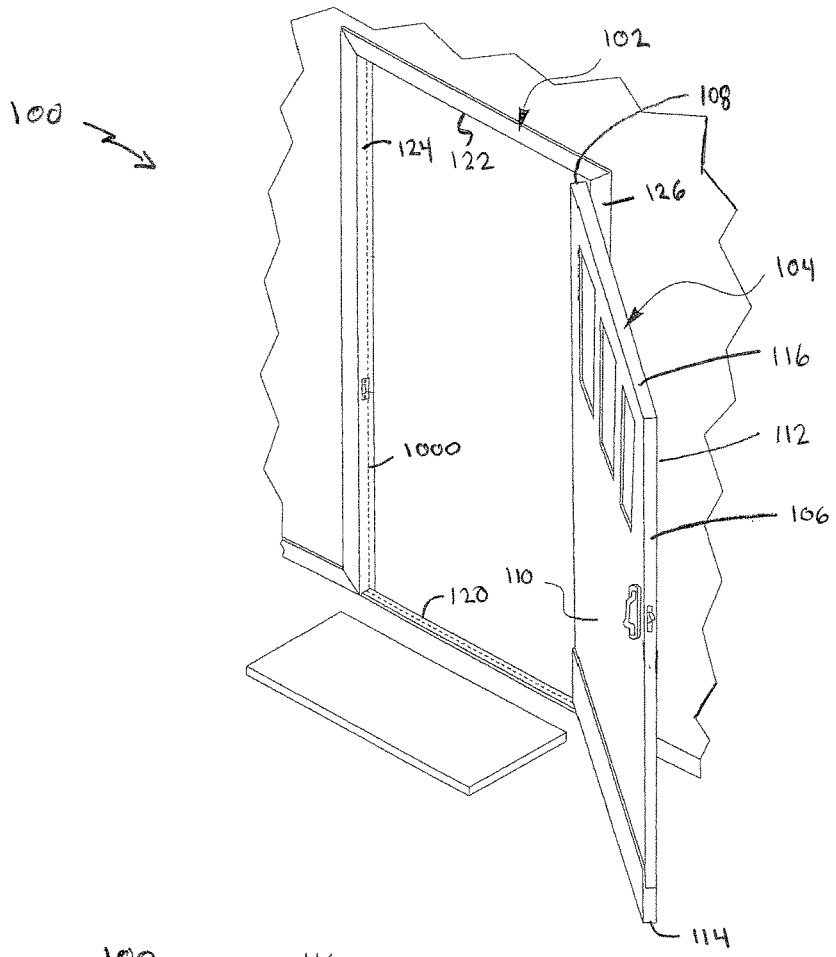
FIG. 1 is a perspective view of an exemplary embodiment of a door assembly with the door in an open position.
Figure 2:
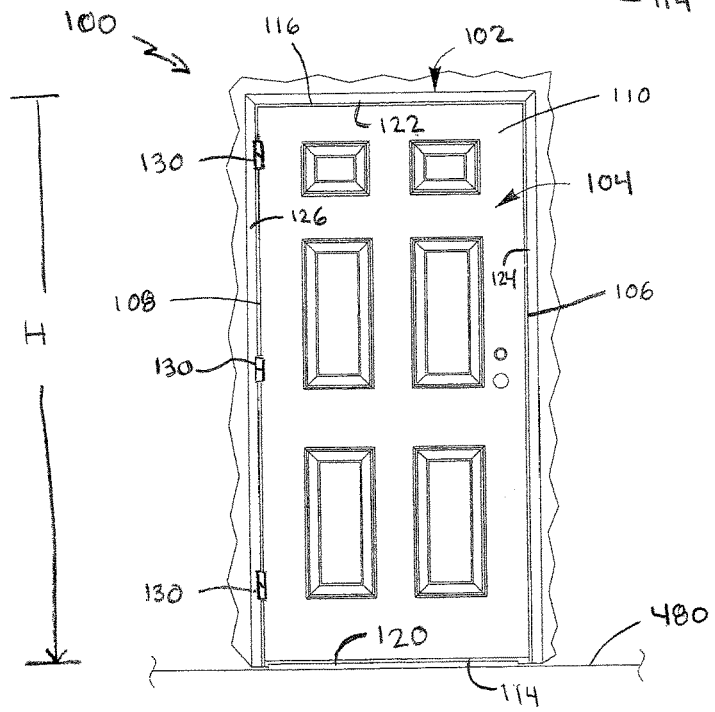
FIG. 2 is a front view of the door assembly of FIG. 1 with the door in a closed position.

FIGS. 1 and 2 illustrates an exemplary embodiment of a door assembly 100 including a door frame 102 and a door 104 that is connected to the frame such that the door is pivotable between an open position (FIG. 1) and a closed position (FIG. 2). The door assembly 100 may take a wide variety of different forms and be used in a variety of applications. For example, in an exemplary embodiment, the door is a residential building door, such as an entrance door of a house. Further, the shape and size of the door and the door frame may vary in different embodiments. Any suitable shaped and sized door and frame may be used.

In the exemplary embodiment of FIGS. 1 and 2, the door 104 includes a first edge surface 106, a second edge surface 108 spaced apart from and parallel to the first edge surface, a first face surface 110 that extends from the first edge surface to the second edge surface, a second face surface 112 that is opposed to and spaced apart from the first face surface and extends from the first edge surface to the second edge surface, a third edge surface 114 that is perpendicular to and extends between the first edge surface and the second edge surface, and a fourth edge surface 116 that is parallel to and spaced apart from the third edge surface and that extends between the first edge surface and the second edge surface.

The door frame 102 is shaped complimentary to the door 104 in that it closely surrounds the periphery of the door. The door frame 102 includes a sill section 120, a top section 122 spaced part from and parallel to the sill section, a first side section 124 that is perpendicular to and extends between the sill section and the top section, and a second side section 126 that is spaced apart from and parallel to the first side section and that is perpendicular to and extends between the sill section and the top section. Any one or more of the door frame sections may also include additional accessories. For example, the door frame 102 may include jamb stops, a trim piece, such as a brick molding, that hides the interface between a wall and the door frame, a frame extending component, such as a screen door adapter or track, or a sill extending component, such as a sill extender that attaches to the sill to cover a larger rough frame member.

The door 104 is pivotably attached to the door frame 102 by one or more hinges 130 configured to move the door downward toward the sill section 120 when the door is moved from the open position to the closed position. The one or more hinges 130 may be configured in a variety of ways. Any hinge capable of pivotably attaching the door to the door frame such that the door can be moved between an open position and a closed position and also moving the door downward relative to the door frame while the door is moving to the closed position may be used.

Figure 3A:
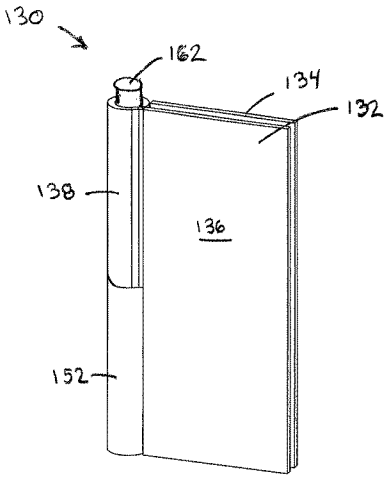
FIG. 3A is a perspective view of an exemplary embodiment of a hinge for the door assembly of FIG. 1.
Figure 3B:
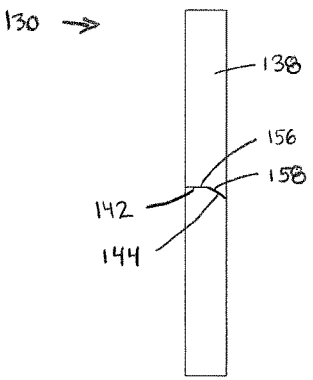
FIG. 3B is an end view of the hinge of FIG. 3A.
Figure 4A:
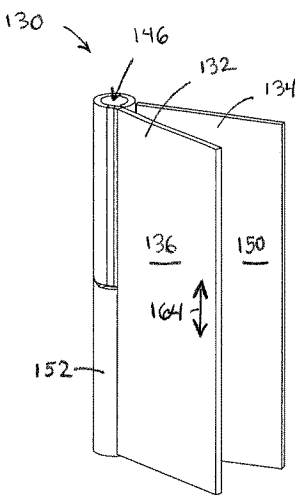
FIG. 4A is a perspective view of the hinge of FIG. 3A with a leaf rotated to a second position.
Figure 4B:
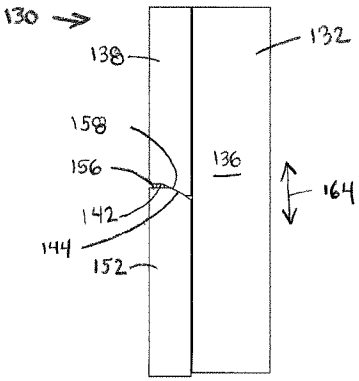
FIG. 4B is an end view of the hinge of FIG. 4A.
Figure 5A:
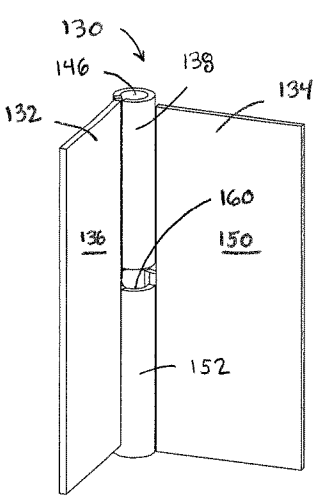
FIG. 5A is a perspective view of the hinge of FIG. 3A with a leaf rotated to a third position.

In the exemplary embodiment of FIGS. 3-5, the hinge 130 includes a door side member 132 and a frame side member 134. The door side member 132 includes a leaf 136 and a knuckle portion 138. The leaf 136 may be configured for attachment with the door 104 in any suitable manner, such as for example, a well known manner such as screws or other fasteners. The knuckle portion 138 defines engagement surfaces including a flat surface 142 and a ramped surface 144 and a longitudinal passage 146 (see FIG. 4A). The frame side member 134 includes a leaf 150 and a knuckle portion 152. The leaf 150 may be configured for attachment with a door frame 102 in any suitable manner, such as for example, a well known manner such as screws or other fasteners. The knuckle portion 152 defines engagement surfaces having a flat surface 156 and a ramped surface 158 and a longitudinal passage 160 (see FIG. 5A).

Figure 5B:
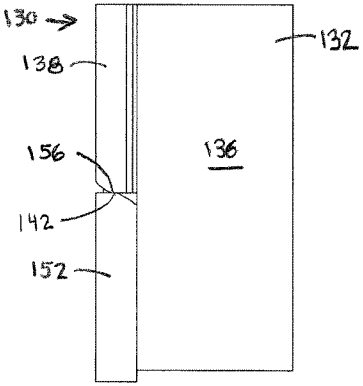
FIG. 5B is an end view of the hinge of FIG. 5A.

The door side member 132 and the frame side member 134 are assembled by arranging the knuckle portion 138 of the door side member adjacent the knuckle portion 152 of the frame side member 134 such that the passage 146 aligns with the passage 160 and placing a pin 162 (see FIG. 3A) through both. FIGS. 5A-5B show the hinge 130 in an open position where the door side member 132 is illustrated as being about 70 degrees from the frame side member 134. FIGS. 4A-4B show the hinge 130 after the door side member 132 has been moved about 50 degrees toward the closed position (i.e. about 20 degrees before reaching a fully closed position). FIGS. 3A-3B show the hinge 130 in a closed position where the door side member 132 is parallel to the frame side member 134.

In FIGS. 5A-5B, the flat surface 142 of the door side member 132 engages the flat surface 156 of the frame side member 134. During rotation of the door side member 132, toward the closed position, the flat surface 142 and the flat surface 156 rotate out of engagement and the ramped surface 144 of the door side member 132 engages the ramped surface 158 of the frame side member 134. As the ramped surface 144 moves along the ramped surface 158, the door side member 132, in addition to pivoting relative to the frame side member, also translates vertically relative to the frame side member 134 as shown by arrows 164 in FIGS. 4A-4B. The door side member 132 will continue to move downward relative to the frame side member 134 until the door reaches the closed position shown in FIGS. 3A-3B.

Thus, in the exemplary embodiment of FIGS. 3A-5B, the hinge 130 is configured to move the door 104 downward relative to the door frame 102 only during the last portion of rotation of the door from the open position to the closed position. In the exemplary embodiment, the movement of the door 104 downward begins when the door is 50 degrees, or about 50 degrees, open. In other embodiments, however, the hinge 130 may be configured to move the door downward during less than the last 50 degrees, such as for example, during the last 40 degrees, the last 20 degrees, the last 10 degrees, or any amount of degrees less than 50 degrees. Further, in other embodiments, the hinge 130 may be configured to move the door 104 downward during more than the last 50 degrees.

In the exemplary embodiment, during movement of the door 104 downward relative to the door frame 102, the third edge surface 114 (see FIG. 2) of the door is maintained in a parallel relationship, or substantially parallel relationship, with the sill section 120 as the door is moved between the open position and the closed position.

FIGS. 6A-10B illustrate an exemplary embodiment of a hinge 230 for use with the door assembly 100. The hinge 230 includes a door side member 232 and a frame side member 234. The door side member 232 includes a leaf 236 and a knuckle portion including a first ring 240 and a second ring 242. The first ring 240 has a first longitudinal passage 244 and the second ring 242 has a second longitudinal passage 246 aligned with the first passage (see FIG. 6A). In other embodiments, however, the door side member 232 may have more or less than two rings. The leaf 236 may be configured for attachment with the door 104 in any suitable manner, such as for example, a well known manner such as screws or other fasteners. The leaf 236 includes a projection 250 extending outward toward the frame side member 234. The projection 250 includes a rounded, angled, or tapered upper surface 252 and an upper flat surface 253.

The frame side member 234 includes a leaf 254 and a knuckle portion having a first ring 260 and a second ring 262. The first ring 260 has a first longitudinal passage 264 and the second ring 262 has a second longitudinal passage 266 aligned with the first passage (see FIG. 6A). In other embodiments, however, the frame side member 234 may have more or less than two rings. The leaf 254 may be configured for attachment with the frame 102 in any suitable manner, such as for example, a well known manner such as screws or other fasteners. The leaf 250 defines an opening 270 for receiving the projection 250 on the leaf 236 of the door side member 232. The opening 270 includes an engagement surface 272 configured to engage the upper surface 252. The hinge 230 also includes a resilient member 274, such as for example, a spring, a rubber component, or similar member. The resilient member 274 may be configured and arranged in a variety of ways. In the exemplary embodiment, the resilient member 274 is a spring disposed between the first ring 240 of the door side member 232 and the second ring 262 of the frame side member 234 to bias the first ring 240 away from the second ring 262.

The door side member 232 and the frame side member 234 are assembled by positioning the first door side ring 240 adjacent the first frame side rings 260 such that passage 244 is aligned with passage 264 and positioning the second door side ring 242 adjacent the second frame side rings 262 such that passage 246 is aligned with passage 266. A pin 276 (see FIG. 7A) is inserted through the passages 244, 246, 264, 266 and the spring 274.

Figures 6A, 6B, 7A, 7B, 8A, 8B, 9A, 9B, 10A, 10B:
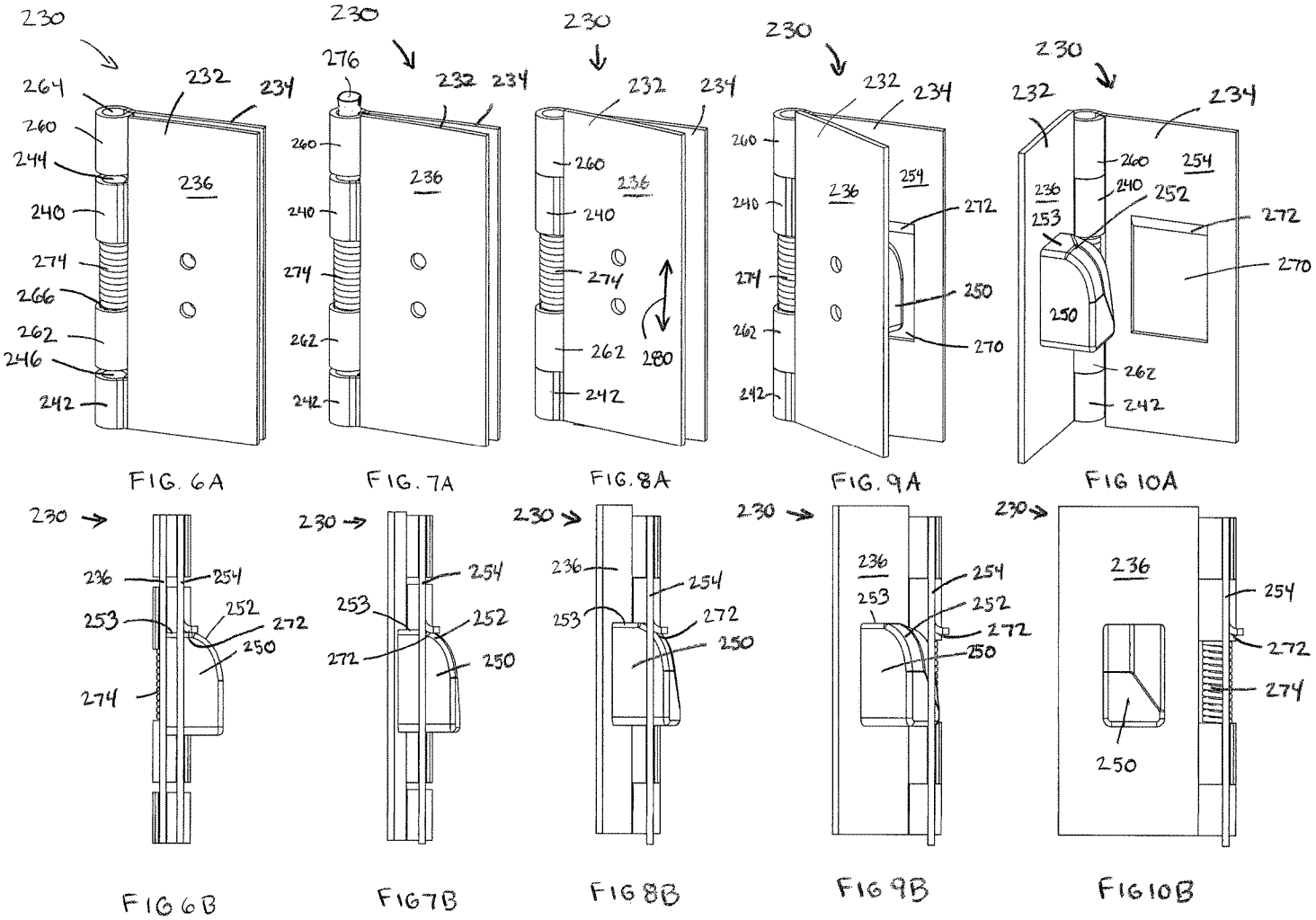
FIG. 6A is a perspective view of an exemplary embodiment of a hinge for the door assembly of FIG. 1.
FIG. 6B is an end view of the hinge of FIG. 6A.
FIG. 7A is a perspective view of the hinge of FIG. 6A with a leaf rotated to a second position.
FIG. 7B is an end view of the hinge of FIG. 7A.
FIG. 8A is a perspective view of the hinge of FIG. 6A with a leaf rotated to a third position.
FIG. 8B is an end view of the hinge of FIG. 8A.
FIG. 9A is a perspective view of the hinge of FIG. 6A with a leaf rotated to a fourth position.
FIG. 9B is an end view of the hinge of FIG. 9A.
FIG. 10A is a perspective view of the hinge of FIG. 6A with a leaf rotated to a fifth position.
FIG. 10B is an end view of the hinge of FIG. 10A.

The door side member 232 and the hinge side member 234 are arranged and configured such that in addition to pivoting about an axis of the hinge, the door side member 232 translates vertically relative to the frame side member 234 as shown by arrows 280 in FIG. 8A. In particular, FIGS. 10A-10B show the door side member 232 in an open position and FIGS. 9A-9B show the door side member approaching the closed position. As shown in FIGS. 8A-8B, when the door side member 232 is near the closed position, the projection 250 begins to enter the opening 270 and the upper surface 252 engages the engagement surface 272 of the frame side member 234. The projection 250, however, is misaligned with the opening 270 such that the engagement surface 272 is below the upper flat surface 253 of the projection. As the door 104 closes further, as shown in FIGS. 6A-7B, the upper surface 252 acts as a wedge against the engagement surface 272 to force the door side member 232 downward relative to the frame side member 234 and compress the resilient member 274 until the projection 250 is fully received within the opening 270 and the door is in the closed position. Thus, as the door 104 closes, the door moves vertically downward relative to the door frame 102.

The hinge 230 is configured to move the door 104 downward relative to the door frame 102 only during the last portion of rotation of the door from the open position to the closed position. In the exemplary embodiment, the movement of the door 104 downward occurs only during the last 20 degrees, or about 20 degrees, of the door closing. In other embodiments, however, the hinge 230 may be configured to move the door downward during less than the last 20 degrees, such as for example, during the last 15 degrees or the last 10 degrees, or more than the last 20 degrees, such as during the last 25 degrees or the last 30 degrees.

In the exemplary embodiment, during movement of the door 104 downward relative to the door frame 102, the third edge surface 114 (see FIG. 2) of the door is maintained in a parallel relationship, or substantially parallel relationship, with the sill section 120 as the door is moved between the open position and the closed position.

When the door 104 is moved from the closed position to the open position, the bias of the resilient member 274 moves the door side member 232 upward relative to the frame side member 234 as the projection 250 exits the opening 270 and the engagement surface 272 disengages the upper surface 252. Thus, as the door 104 opens, the third edge surface 114 of the door moves away from the sill section 120 of the door frame 102.

The door assembly 100 includes one or more seals for providing a seal between the door frame 102 and the door 104 when the door is in the closed position (FIG. 2). The one or more seals may be configured in a variety of ways. For example, the one or more seals may be attached to the door frame 102, to the door 104, or to both. The one or more seals may extend around the entire periphery of the door 104 and/or door frame 102 between the door and the door frame when the door is closed or may only extend around a portion of the periphery. The number, shape and size of the seal may vary in different embodiments and may vary between different portions of each seal.

Figure 11:
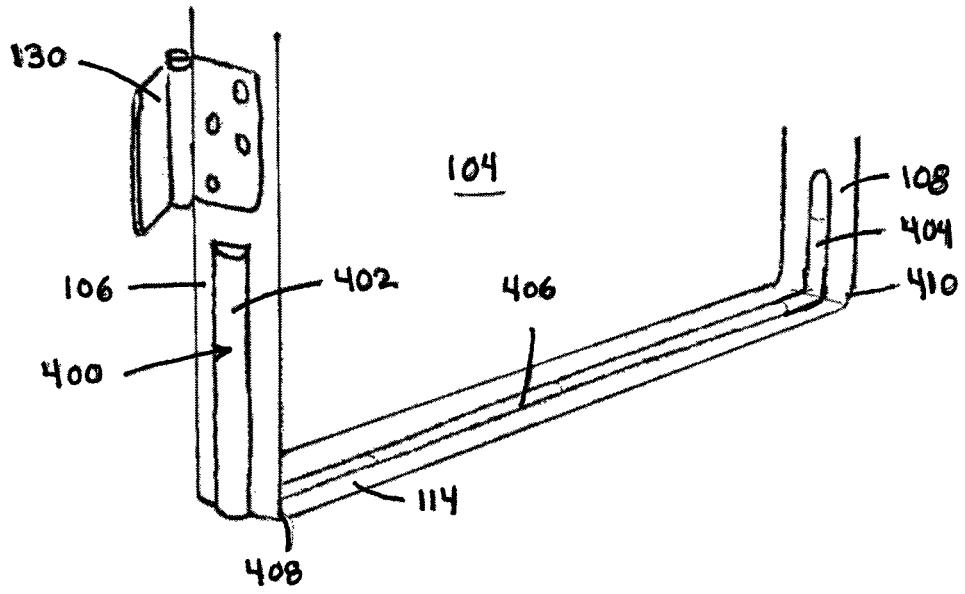
FIG. 11 is a perspective illustration of an exemplary embodiment of a door seal for the door assembly of FIG. 1.
Figure 12:
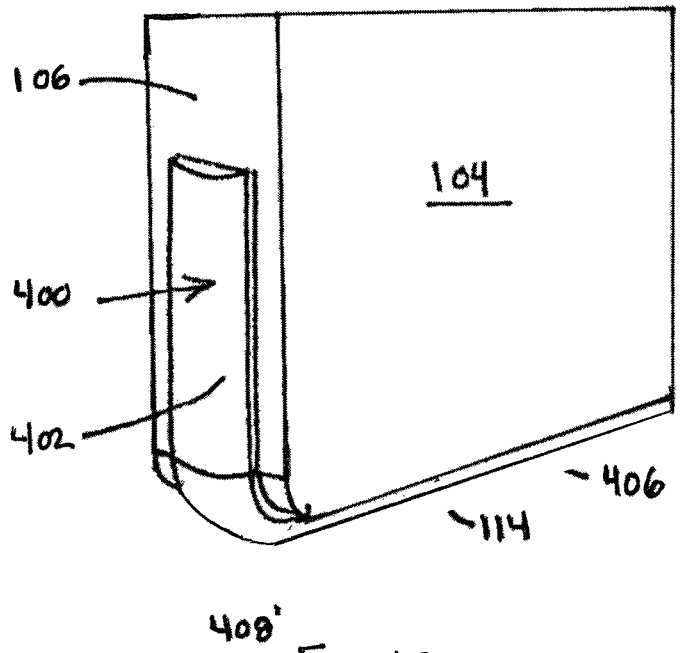
FIG. 12 is a partial perspective view of the seal of FIG. 11.

In the exemplary embodiment of FIGS. 11 and 12, the door assembly 100 includes a door seal 400 attached to the door 104. The door seal 400 includes a first portion 402 attached to and extending along at least a portion of the first edge surface 106, a second portion 404 attached to and extending along a portion of the second edge surface 108, and a third portion 406 attached to and extending along the entire length, or substantially the entire length, of the third edge surface 114. In the exemplary embodiment, the first portion 402, the second portion 404, and the third portion 406 are formed as a single piece seal wrapped around the door 104 from the first edge surface 106 to the second edge surface 108. In other embodiments, however, the door seal 400 may be formed from multiple pieces. For example, each of the first portion 402, the second portion 404, and the third portion 406 may be formed as separate pieces that are attached together or arranged adjacently. Further, each of the first, second, and third portions 402, 404, 406 may include multiple pieces forming each portion.

In the exemplary embodiment, the first portion 402 and the second portion 404 extend less than half of the height H (see FIG. 2) of the first edge surface 106 and the second edge surface 108, respectively. In one exemplary embodiment, the first portion 402 and the second portion 404 extend in the range of two inches to four inches, or about two to four inches, from the third edge surface 114 up the first edge surface 106 and the second edge surface 108, respectively. In other embodiments, however, the first portion 402 and the second portion 404 may extend more than four inches or less than two inches up the first edge surface 106 and the second edge surface 108, respectively. The first portion 402 and the second portion 404 may extend the same distance up the first edge surface 106 and the second edge surface 108, respectively, or may extend different distances.

The door 104 may include a first rounded corner 408 between both the first edge surface 106 and the third edge surface 114 and a second rounded corner 410 between the second edge surface 108 and the third edge surface 114.

Figure 13:
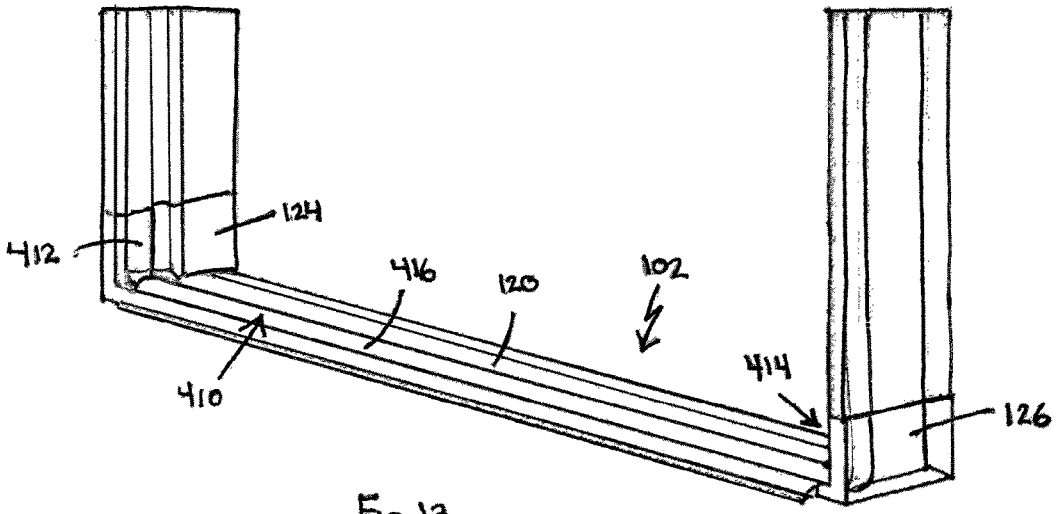
FIG. 13 is a perspective view of an exemplary embodiment of a door frame seal for the door assembly of FIG. 1.

Referring to FIG. 13, the door assembly 100 may optionally include a frame seal 410 attached to the door frame 102. In the exemplary embodiment, the frame seal 410 includes a first portion 412 attached to and extending along at least a portion of the first side section 124, a second portion 414 attached to and extending along at least a portion of the second side surface 126, and a third portion 416 attached to and extending along the entire length, or substantially the entire length, of the sill section 120. In the exemplary embodiment, the first portion 412, the second portion 414, and the third portion 416 are formed as a single piece seal wrapped around the frame 102 from the first side section 124 to the second side surface 126. In other embodiments, however, the frame seal 410 may be formed from multiple pieces. For example, each of the first portion 412, the second portion 414, and the third portion 416 may be formed as separate pieces that are attached together or arranged adjacently. Further, each of the first, second, and third portions 412, 414, 416 may include multiple pieces forming each portion.

Figure 14:
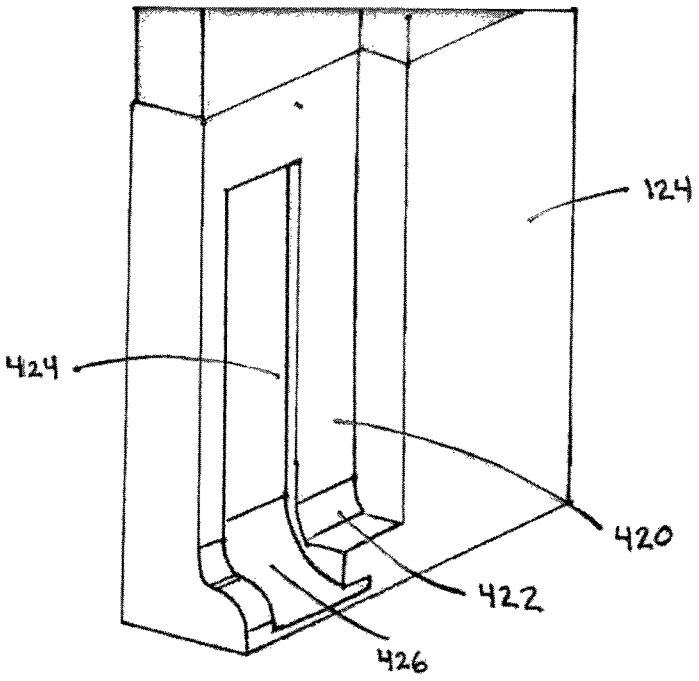
FIG. 14 is a partial perspective view of an exemplary embodiment of a door frame side section of the door assembly of FIG. 1.

Referring to FIG. 14, the first side section 124 of the frame 102 may include a first cutout portion 420 configured to receive the first edge surface 106 of the door 104. The first cutout portion 420 may include a rounded corner 422 for receiving the first rounded corner 408 of the door 104. The first side section 124 may include a second cutout portion 424 configured to receive the first portion 412 of the frame seal 410. The second cutout portion 424 may include a rounded corner 426.

Figure 15:
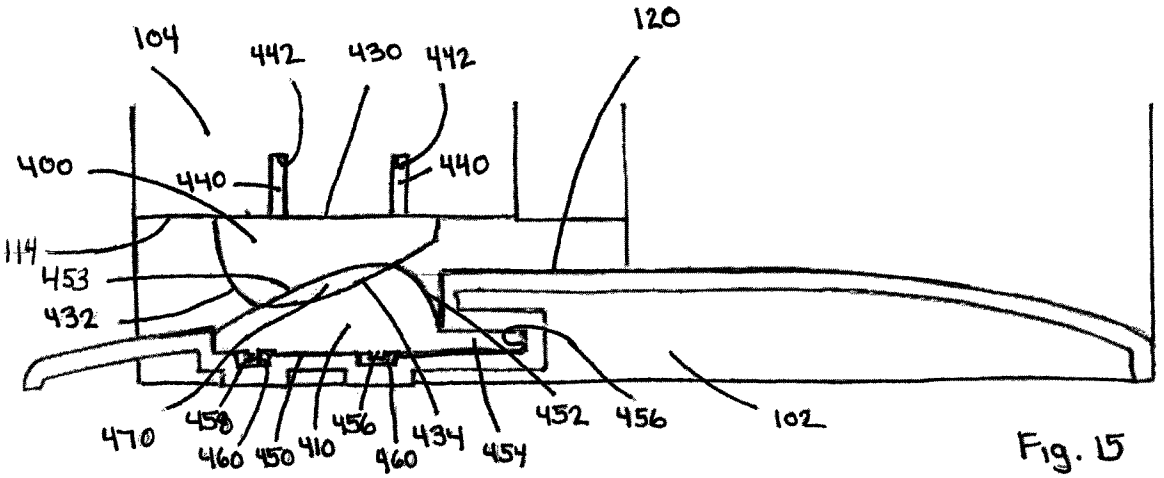
FIG. 15 is a partial cross-section view of the door assembly of FIG. 1 showing the door seal of FIG. 12 and the door frame seal of FIG. 13.

Referring to FIG. 15, the door seal 400 has a side profile generally in the shape of a bisected tear drop. The door seal 400 includes a flat, or generally flat, first surface 430 and a curved second surface 432 having a sloped surface 434. The door seal 400 may be attached to the door 104 by any suitable means, such as for example, by an adhesive, fasteners, an interference fit, or another suitable manner. In the exemplary embodiment of FIG. 14, the door seal 400 is attached to the door 104 by a kerf-style connection. In particular, the door seal 400 include a pair of spaced apart projections 440 extending outward from, and generally perpendicular to, the first surface 430. The third edge surface 114 of the door 104 includes a pair of spaced apart channels 442 configured to receive the pair of projections 440. The door seal 400 is attached to the door 104 by inserting the projections 440 into the channels 442. The projections 440 may be held in the channels 442 via an interference fit and/or an adhesive, or any suitable manner of retention.

The frame seal 410 has a side profile generally in the shape of a bisected tear drop. The frame seal 410 includes a flat, or generally flat, first surface 450 and a curved second surface 452 having a sloped surface 454. The frame seal 410 may be attached to the 102 by any suitable means, such as for example, by an adhesive, fasteners, an interference fit, or another suitable manner. In the exemplary embodiment, the door seal 400 is attached to the door 104 by a kerf-style connection. In particular, the frame seal 410 includes a projection 454 extending outward from, and generally parallel to, the first surface 450. The sill section 120 of the frame 104 includes a channel 456 configured to receive the projections 454. The frame seal 410 is attached to the door frame 102 by inserting the projection 454 into the channel 456. The projection 454 may be held in the channel 456 via an interference fit and/or an adhesive, or any suitable manner of retention. The frame seal 410 may also include a pair of spaced apart ridges 458 extending outward from the first surface 450. The sill section 120 may include a pair of spaced apart channels 460 for receiving the ridges 458. The interface between the ridges 458 and channels 460 resist movement of the frame seal 410 in the direction parallel to the first surface 450.

The door seal 400 and the frame seal 410 may be made from a variety of materials. Any materials capable of forming an air tight seal between the door 104 and the door frame 102 may be used. Each of the door seal 400 and the frame seal 410 may be made of more than one material. In addition, the door seal 400 may be made of a material that is different than the material used for the frame seal 410. Suitable materials for the door seal and the frame seal may include, but not be limited to, expanded EPDM (methylene propylene diene monomer) rubber, silicone sponge, urethane, silicone, neoprene, butyl, or other suitable materials.

In operation, when the door 104 moves from the open position to the closed position, during the last 50 degrees or less of door closure, the door 104 moves downward relative to the door frame 102. In particular, the third edge surface 114 of the door 102 moves downward toward the sill section 120 of the door frame 102. When near the closed position, the door seal 400 engages the frame seal 410. FIG. 15 illustrates an overlap region 470 between the door seal 400 and the frame seal 410 in the closed position. In actuality, the door seal 400 and the frame seal 410 will comply and conform to each other in the overlap region 470 to improve sealing. In part due to the material selection for each seal, in some embodiments the door seal 400 and the frame seal 410 comply equally. In other embodiments, however, the door seal 400 may comply more or less than the frame seal 410.

In one exemplary embodiment, the downward movement of the door 104 relative to the door frame 102 increases the compression force between the door seal 400 and the frame seal 410 when in the closed position. The increased compression force aids in providing a sufficient seal, such as for example an air-tight or water tight seal, between the door 104 and the frame 102. In other embodiments, however, forces between the door seal and the frame seal may function differently. When the door 104 is moved from the closed position to the open position, the door moves upward relative to the door frame 102. As a result, the third edge surface 114 and the door seal 400 move vertically upward which provides more clearance between the door seal 400 and the floor 480 and allows the door 104 to pivot more easily.

Figure 16:
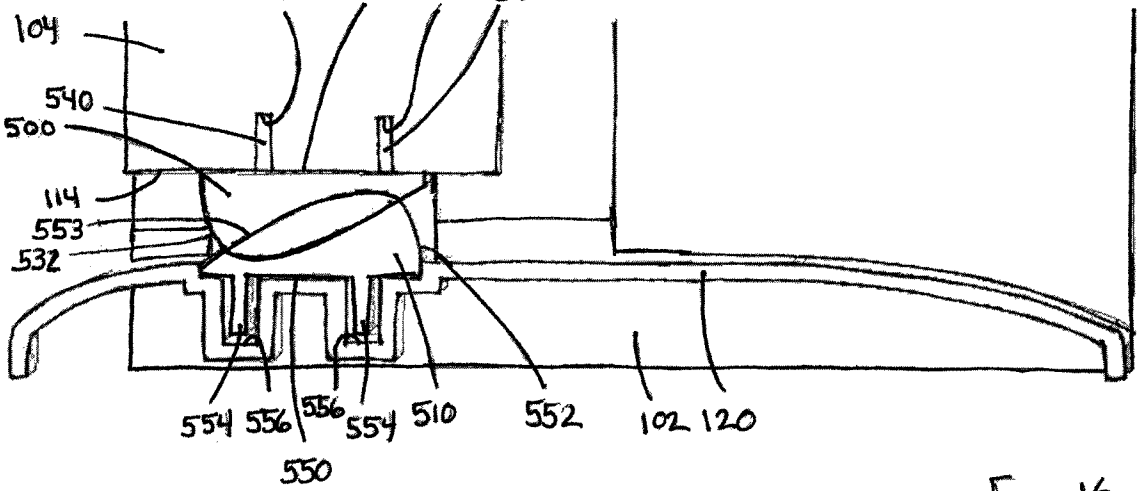
FIG. 16 is a partial cross-section view of the door assembly of FIG. 1 showing another exemplary embodiment of a door frame seal for the door assembly.
Figure 17:
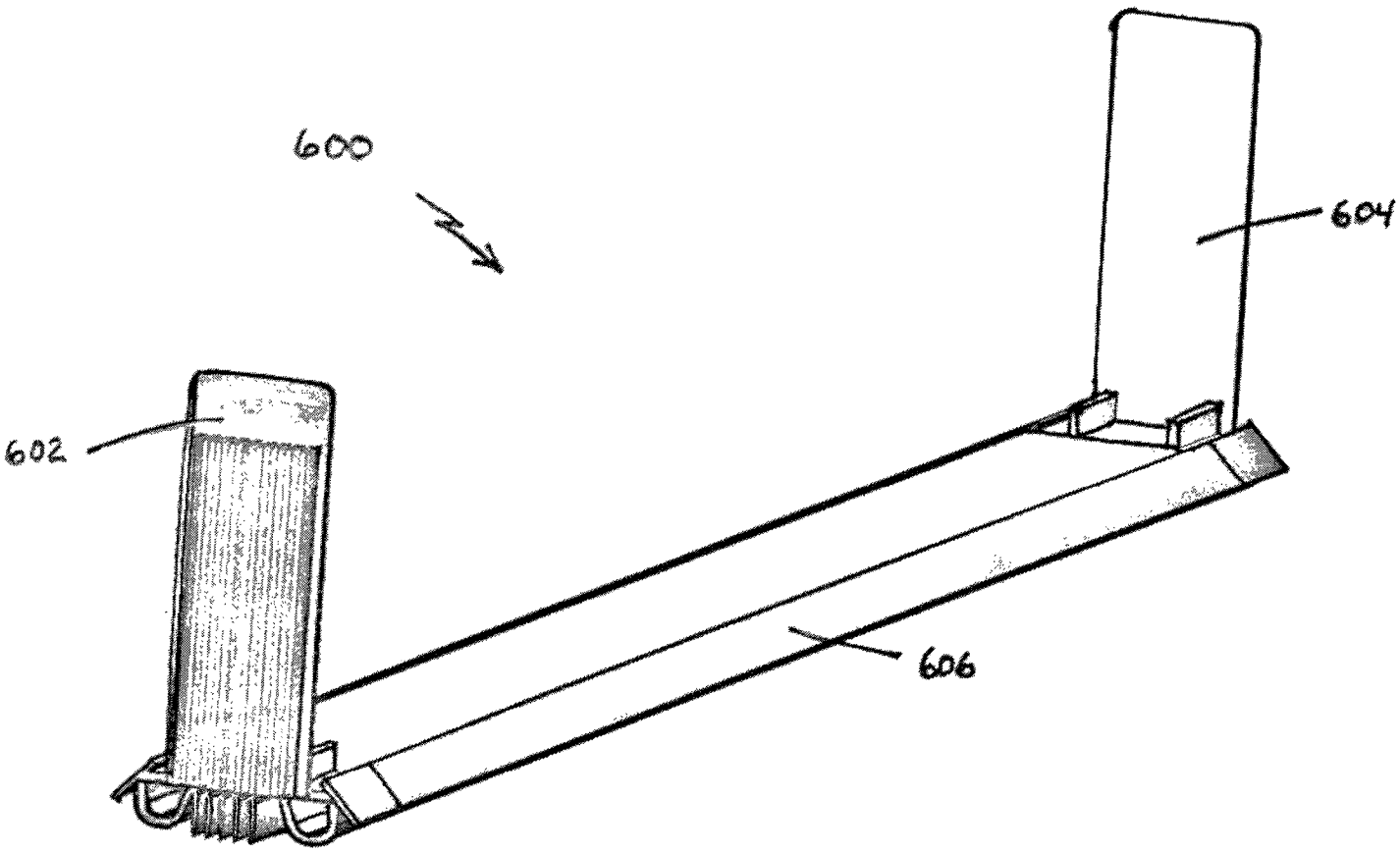
FIG. 17 is a perspective view of an exemplary embodiment of a door seal for the door assembly of FIG. 1.

FIG. 16 illustrates another exemplary embodiment of a door seal 500 and frame seal 510 for the door assembly 100. The door seal 500 is similar to the door seal 400 of FIG. 15 in that it has a side profile generally in the shape of a bisected tear drop including a flat, or generally flat, first surface 530 and a curved second surface 532 having a sloped surface 534. The door seal 500 may be attached to the door 104 by any suitable means, such as for example, by an adhesive, fasteners, an interference fit, or another suitable manner. In the exemplary embodiment, the door seal 500 is attached to the door 104 by a kerf-style connection. In particular, the door seal 500 includes a pair of spaced apart projections 540 extending outward from, and generally perpendicular to, the first surface 530. The third edge surface 114 of the door 104 includes a pair of spaced apart channels 542 configured to receive the pair of projections 540. The door seal 500 is attached to the door 104 by inserting the projections 540 into the channels 542. The projections 540 may be held in the channels 542 via an interference fit and/or an adhesive or any suitable manner of retention.

The frame seal 510 has a side profile generally in the shape of a bisected tear drop. The frame seal 510 includes a flat, or generally flat, first surface 550 and a curved second surface 552 having a sloped surface 554. The frame seal 510 may be attached to the 102 by any suitable means, such as for example, by an adhesive, fasteners, an interference fit, or another suitable manner. In the exemplary embodiment of the door seal 500 is attached to the door 104 by a kerf-style connection. In particular, the frame seal 510 includes a pair of spaced apart projections 554 extending outward from, and generally perpendicular to, the first surface 550. The sill section 120 of the frame 102 includes a pair of spaced apart channels 556 configured to receive the pair of projections 554. The frame seal 510 is attached to the frame 102 by inserting the projections 554 into the channels 556. The projections 554 may be held in the channels 556 via an interference fit and/or an adhesive, or any suitable manner of retention.

The door seal 500 and the frame seal 510 may be made from a variety of materials. Any materials capable of forming a seal between the door 104 and the door frame 102 may be used. Each of the door seal 500 and the frame seal 510 may be made of more than one material. In addition, the door seal 500 may be made of a material that is different than the material used for the frame seal 510. Suitable materials for the door seal and the frame seal may include, but not be limited to, expanded EPDM (methylene propylene diene monomer) rubber, silicone sponge, urethane, silicone, neoprene, butyl, or other suitable materials.

FIGS. 17-23 illustrate another exemplary embodiment of a door seal 600 for the door assembly 100. The door seal 600 may be configured in a variety of ways. For example, the number of seal members, the shape of each member or portion, and the size of each member or portion may vary in different embodiments and may vary between different portions of each seal member. In the exemplary embodiment of FIGS. 17-23, the seal 600 includes a first portion 602 attached to and extending along at least a portion of the first edge surface 106 of the door 104, a second portion 604 attached to and extending along at least a portion of the second edge surface 108 of the door, and a third portion 606 attached to and extending along the entire length, or substantially the entire length, of the third edge surface 114 of the door.

In the exemplary embodiment, the first portion 602 and the second portion 604 extend less than half of the height H (see FIG. 2) of the first edge surface 106 and the second edge surface 108, respectively. In one exemplary embodiment, the first portion 602 and the second portion 604 extend in the range of two inches to four inches, or about two to four inches, from the third edge surface 114 up the first edge surface 106 and the second edge surface 108, respectively. In other embodiments, however, the first portion 602 and the second portion 604 may extend more than four inches or less than two inches up the first edge surface 106 and the second edge surface 108, respectively. The first portion 602 and the second portion 604 may extend the same distance up the first edge surface 106 and the second edge surface 108, respectively, or may extend different distances. The seal 600 may be attached to the door 104 by any suitable means, such as for example, by an adhesive, fasteners, interference fit, or other suitable attachment.

The first portion 602 and the second portion 604 are designed as separate pieces that are attachable to the third portion 606. In the exemplary embodiment, the first portion 602 includes a first leg 610 and a second leg 612 extending perpendicularly from the first leg. The first leg 610 and the second leg 612 may be formed as a single integral part or may be formed as two or more separate parts attached together. The cross-sectional shape of the seal 600 may vary in different embodiments, across the different portions of the seal, or within each portion. For example, the cross-sectional shape in the first portion 602 may differ from the cross-sectional shape in the second portion 604 or the third portion 606.

Figures 18, 19, 20, 21, 22, 23:
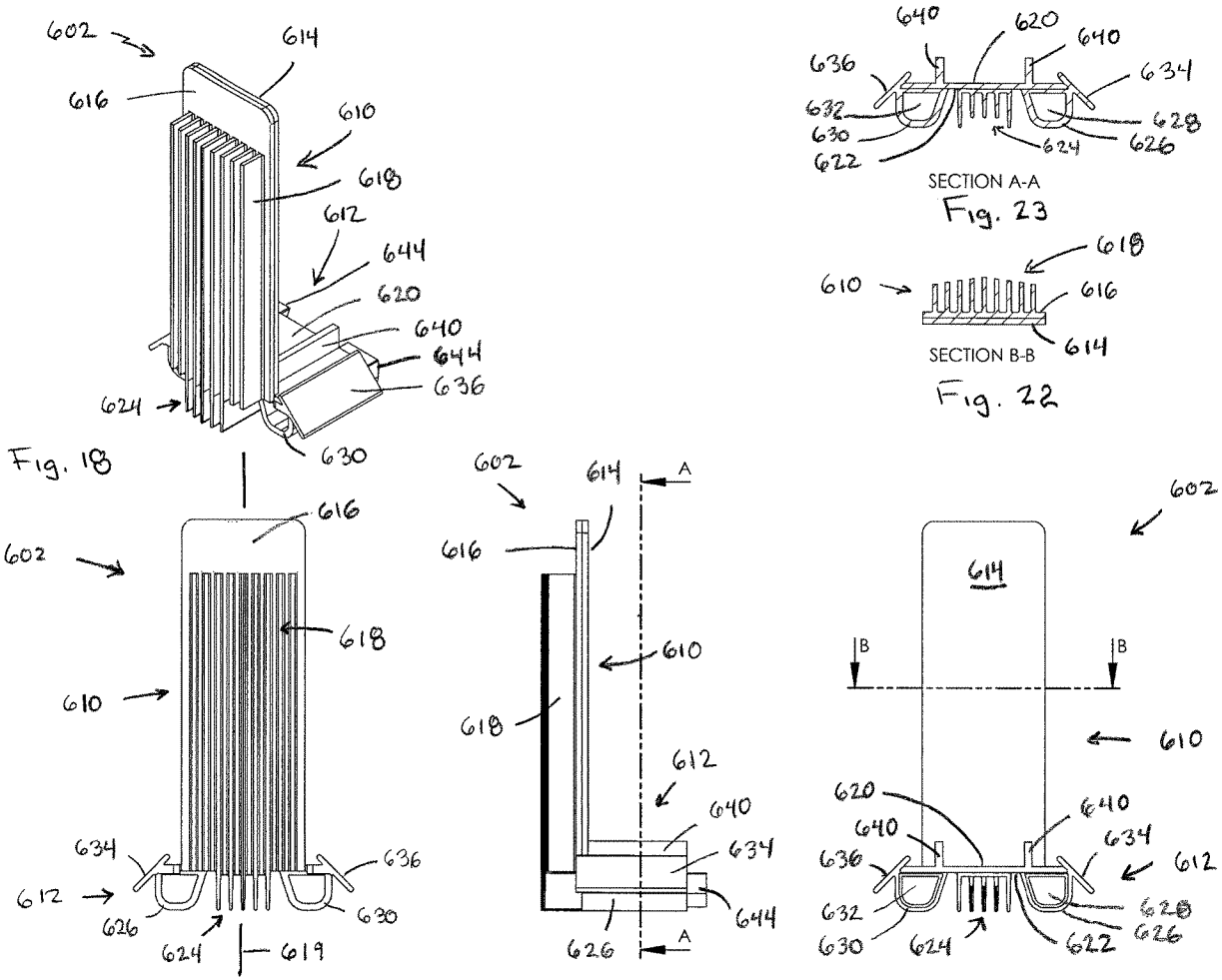
FIG. 18 is a perspective view of a first portion of the seal of FIG. 17.
FIG. 19 is a front view of the first portion of the seal of FIG. 17.
FIG. 20 is a side view of the first portion of the seal of FIG. 17.
FIG. 21 is a back view of the first portion of the seal of FIG. 17.
FIG. 22 is a cross-section of a first leg of the first portion of the seal of FIG. 17.
FIG. 23 is a cross-section of a second leg of the first portion of the seal of FIG. 17.

The first leg 610 includes a first generally planar side surface 614 configured to attach to and the first edge surface 106 of the door and a second generally planar side surface 616 parallel and opposite the first side surface 614. The first leg 610 optionally includes one or more flexible projections 618 extending outward from the second side surface 616 for engaging the door frame 102. The projections 618 may be configured in a variety of ways. For example, the type of projections, the number of projections, the height and length of the projections, and the arrangement of the projections may vary. In the exemplary embodiment, the one or more projections include nine longitudinal ribs that extend along a majority of the first leg 610 parallel to a longitudinal axis 619 (FIG. 18).

The second leg 612 includes a first generally planar side surface 620 configured to attach to the third edge surface 114 of the door 104 and a second generally planar side surface 622 parallel and opposite the first side surface 620. The second leg 612 optionally includes one or more projections extending outward from the second side surface 620. The projections may be configured in a variety of ways. For example, the type of projections, the number of projections, the height and length of the projections, and the arrangement of the projections may vary. In the illustrated embodiment, the projections include a plurality of flexible ribs 624 bracketed by a first bulb 626 forming a first hollow cavity 628 and a second bulb 630 forming a second hollow cavity 632. The first and second bulbs 626, 630 as configured to be compressible and the ribs 624 are flexible such that when the bulbs and ribs contact the door frame 102, they may deform and comply with the frame to a degree to form a seal therewith.

The illustrated embodiment of the second leg 612 also includes a first fin 634 adjacent the first bulb 626 and extending transverse to the first side surface 620 and a second fins 636 spaced apart from the first fin 634 and extending transverse to the first side surface 620. The second leg 612 may also include a pair of parallel spaced apart rails 640 extending outward from the first side surface 620. The rails 640 may be used to connect the first portion 602 to the door 104 via a kerf-style connection similar to that described regarding the seal 400 of FIG. 15.

The second leg 612 is configured to attach to the third portion 606 of the seal 600. The second leg 612 may attach to the third portion 606 in a variety of ways. In the depicted embodiment, the second leg 612 includes one or more male projections 644 configured to be received in corresponding one or more hollow cavities (not shown) on the third portion 606. In the depicted embodiment, the cross sectional shape of the second leg 612 is similar to the cross sectional shape of the third portion 606. Thus, the hollow cavities on the third portion 606 are similar to and align with the hollow cavities 628, 632 on the bulbs 626, 630 of the second leg 612. In other embodiments, however, the cross sectional shape of the second leg 612 may differ from the cross sectional shape of the third portion 606. The one or more projections 644 may be secured to the third portion 606 by interference fit and/or adhesives, or another suitable matter of attachment.

In the exemplary embodiment, the second portion 604 is identical or similar to the first portion 602 and the description of the first portion 602 and its attachment to both the door 104 and the third portion 606 applies equally to the second portion 604. In other embodiments, however, the second portion 604 may differ from the first portion 602.

The door seal 600 may be made from a variety of materials. Any materials capable of forming an air tight seal between the door 104 and the door frame 102 may be used. The door seal 600 may be made from one or more materials. Suitable materials for the door seal 600 may include, but not be limited to, expanded EPDM (methylene propylene diene monomer) rubber, silicone sponge, urethane, silicone, neoprene, butyl, or other suitable materials. Each of the first portion 602, the second portion 604, and the third portion 606 may be made as a single piece mold.

Figure 25:
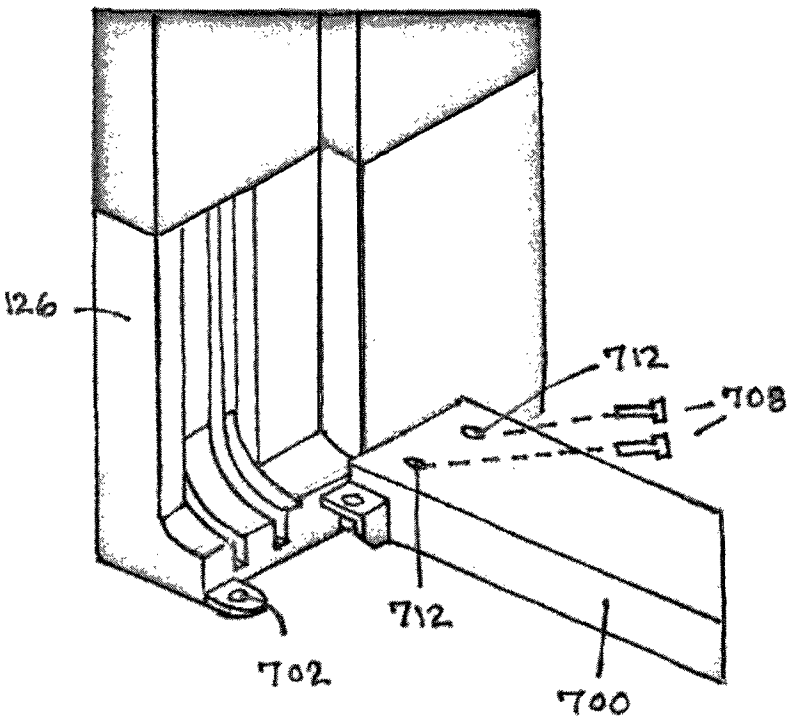
FIG. 25 is a partial perspective of a first side section of the door assembly of FIG. 24 with a cross member installed.
Figure 24:
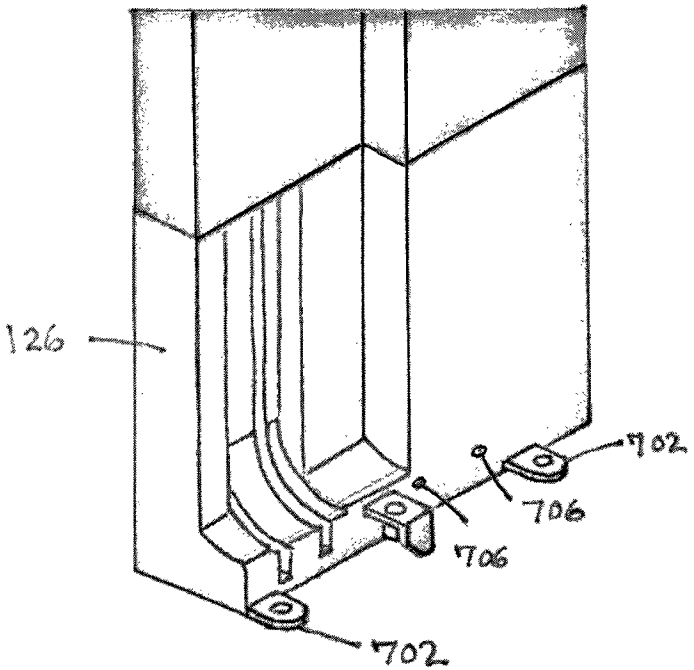
FIG. 24 is a partial perspective view of an exemplary embodiment of a first side section of the door assembly of FIG. 1.

Referring to FIG. 25, the door frame 102 may optionally include a cross member 700. Conventionally, door frames for buildings are shipped and installed already assembled with the sill section 120 and top section 122 attached between the first side section 124 and the second side section 126. The door frame 102 and the door 104, however, may be installed early in the construction process. As a result, the doorway may see significant use during construction of the building which can result in damage, such as scratching, scuffing, and denting, of the sill section 120. The exemplary embodiment of the door frame 102 can be shipped and installed with the cross member 700 extending between the first side section 124 and the second side section 126 in place of the sill section 120. At an appropriate time later in the construction process, the cross member 700 can be removed and the sill section 120 installed or the cross member can remain installed and be covered by the sill section 120.

The cross member 700 may be configured in a variety of ways. Any configuration that provides support for the door frame in place of a sill portion and may be removed or covered by a sill portion after installation of the door frame may be used. In the depicted embodiment, the first side section 126 of the door frame 102 includes one or more attachment points 702 for attaching the first side section 126 to the floor 480 (see FIG. 2). In one exemplary embodiment, the one or more attachment points 702 are eyelets for receiving fasteners for fastening the door frame 102 to the floor 480. In other embodiments, however, the attachment points 702 may be configured to facilitate any suitable attachment method. The first side section 126 may also include one or more attachment points 706 for attaching the cross member 700 to the first side section. For example, the attachment points 706 may be openings for receiving fasteners for attaching the cross member 700. In other embodiments, however, the attachment points can be configured to facilitate any suitable attachment method.

In the illustrated embodiment, the cross member 700 is a generally rectangular bar, such as for example, a 2×4, having a first end 710 and a second end (not shown) spaced apart from the first end. The first end 710 includes one or more openings 712 for receiving the fasteners 708. To install the cross member 700, the one or more openings 712 are aligned with the one or more openings 706 in the first side section 126 and the fasteners 708 are inserted through the openings to attach the cross member to the first side section. While not illustrated, a similar procedure can be completed with the second side portion 126 and the second end (not shown) of the cross member 700.

Figure 26:
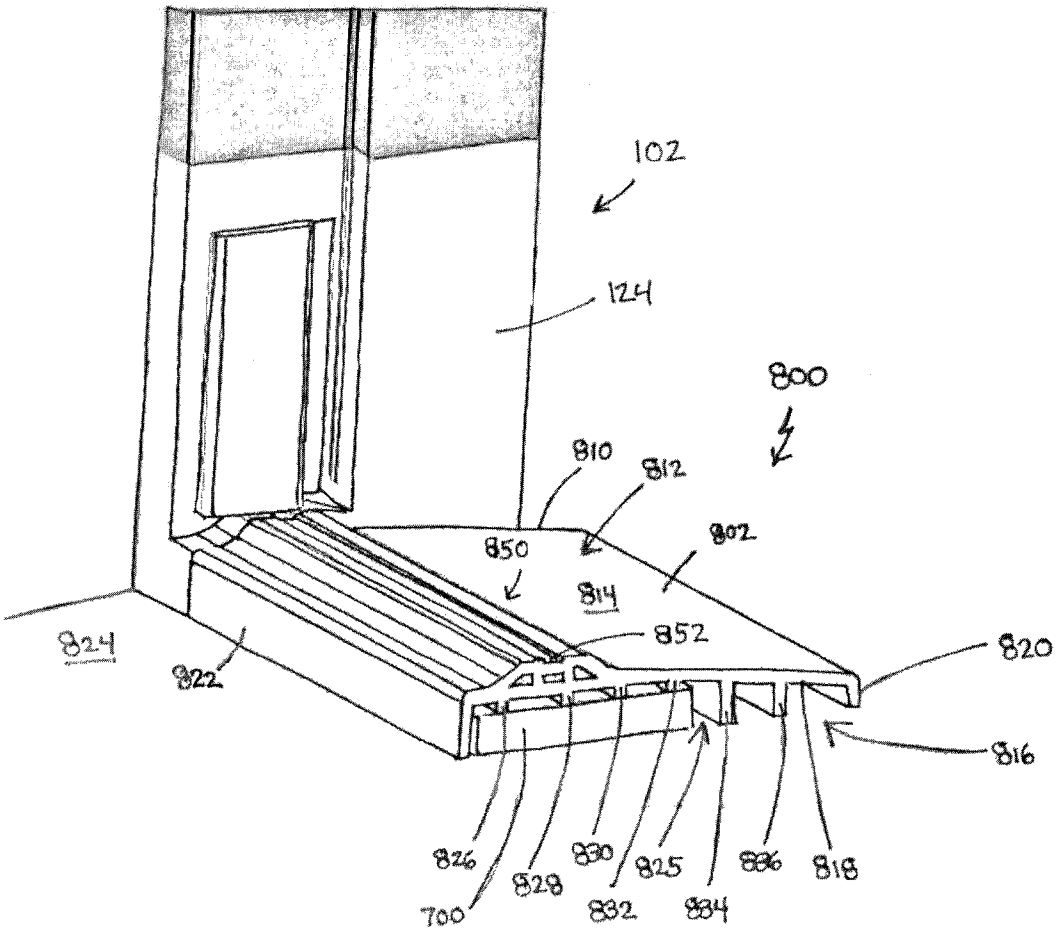
FIG. 26 is a sectioned partial perspective view of an exemplary embodiment of a sill section for use with the cross member of FIG. 25.

FIG. 26 illustrates an exemplary embodiment of a sill section 800 that is configured to at least partially fit over top of and at least partially cover the cross member 700. The sill section 800 may be installed later in the construction process, for example, after the door frame 102 with an optional cross member 700 has been installed. The sill section 800 may be configured in a variety of ways. Any sill section that can be installed to cover, or at least partially cover, an embodiment of the cross member 700 after the door frame has been installed in a doorway can be used. In the exemplary embodiment of FIG. 26, the sill section 800 may include a single piece elongated body 802 having a first end 810 and a second end (not shown) spaced apart from the first end. The sill section 800 may have a length that matches the length of the cross member 700 or the sill section 800 may have a different length. For example, in some embodiments, the sill section 800 may be multiple pieces attached end-to-end to span between the first side section 124 and the second side section 126 (not shown in FIG. 26).

The sill section 800 has an top side 812 having an upper surface 814, a bottom side 816 having a lower surface 818, a first edge 820 extending between the top side 812 and the bottom side 816, and a second edge 822 opposite the first edge 820 and extending between the top side 812 and the bottom side 816. In the exemplary embodiment, the first edge 820 and the second edge 822 extend downward from the lower surface 818 to engage a floor 824 or other surface. The first edge 820 and/or the second edge 822 may extend perpendicularly, or generally perpendicularly from the lower surface 818 or may extend at an angle other than 90 degrees from the lower surface.

The bottom side 816 of the sill section 800 is configured to receive the cross member 700. The bottom side 816 may be configured to receive the cross member 700 in a variety of ways. For example, the bottom side 816 of the sill section 800 may include a recess 825 sized to receive the cross member 700. The recess 825 may be formed in a variety of ways. In the exemplary embodiment, the bottom side 816 includes a plurality of longitudinal ribs extending downward from the lower surface 818. The longitudinal ribs may extend along the entire length, or most of the entire length, of the bottom side 816 of the sill section 800. In the exemplary embodiment, the bottom side 816 includes a first longitudinal rib 826, second longitudinal rib 830, a third longitudinal rib 832, a fourth longitudinal rib 834, a fifth longitudinal rib 836, and a sixth longitudinal rib 838. In other embodiments, however, the sill section 800 may include more or less than six ribs.

In the exemplary embodiment, the longitudinal ribs 826-838 are parallel to, or generally parallel to, each other and to the first and second edges 820, 822. In other embodiments, however, the longitudinal ribs 826-838 may extend parallel to each other or to the first and second edges 820, 822. The recess 826 may be formed, for example, by one or more of the ribs being shorter than the remaining ribs. In the illustrated embodiment of FIG. 26, the first, second, third, and fourth ribs 826-832 are shorter than the fifth and sixth ribs 834, 836. In other embodiments, however, the bottom side 816 may include ribs of equal height but spaced apart to receive the cross member 700. Further, in other embodiments, the bottom side 816 may not include any ribs but instead have a groove or other recessed area capable of receiving the cross member 700.

The first, second, third, and fourth ribs 826-832 are sized such that the cross member 700 can be received in the recess 825 and the sill section 800 covers, or at least partially covers, the cross member 700. In the exemplary embodiment, the first, second, third, and fourth ribs 826-832 engage the cross member 700 while the fifth and sixth ribs 834, 836, the first edge 820, and the second edge 822 engage the floor 824. Thus, the sill section 800 is supported by both the floor 824 and the cross member 700. In other embodiments, however, the sill section 800 may be supported by only the floor 824, only the cross member 700, or by some other surface or in some other manner.

The sill section 800 can be attached to the door frame 102 in any suitable manner. For example, the sill section 800 may be attached to the first side section 124 and the second side section 126 (not shown in FIG. 26) and/or to the cross member 700 by fasteners, adhesive, or other suitable means. The recess 826 may also be sized to provide a friction fit with the cross member 700 to hold the sill section 800 onto the cross member 700.

The top surface 814 of the sill section 800 may be configured in any suitable manner for use as a sill in a door frame 102. In the exemplary embodiment, the top surface includes a raised portion 850 defining a longitudinal groove 852. The groove 852 may be configured to mount a seal (not shown) on the sill section 800.

Figure 27:
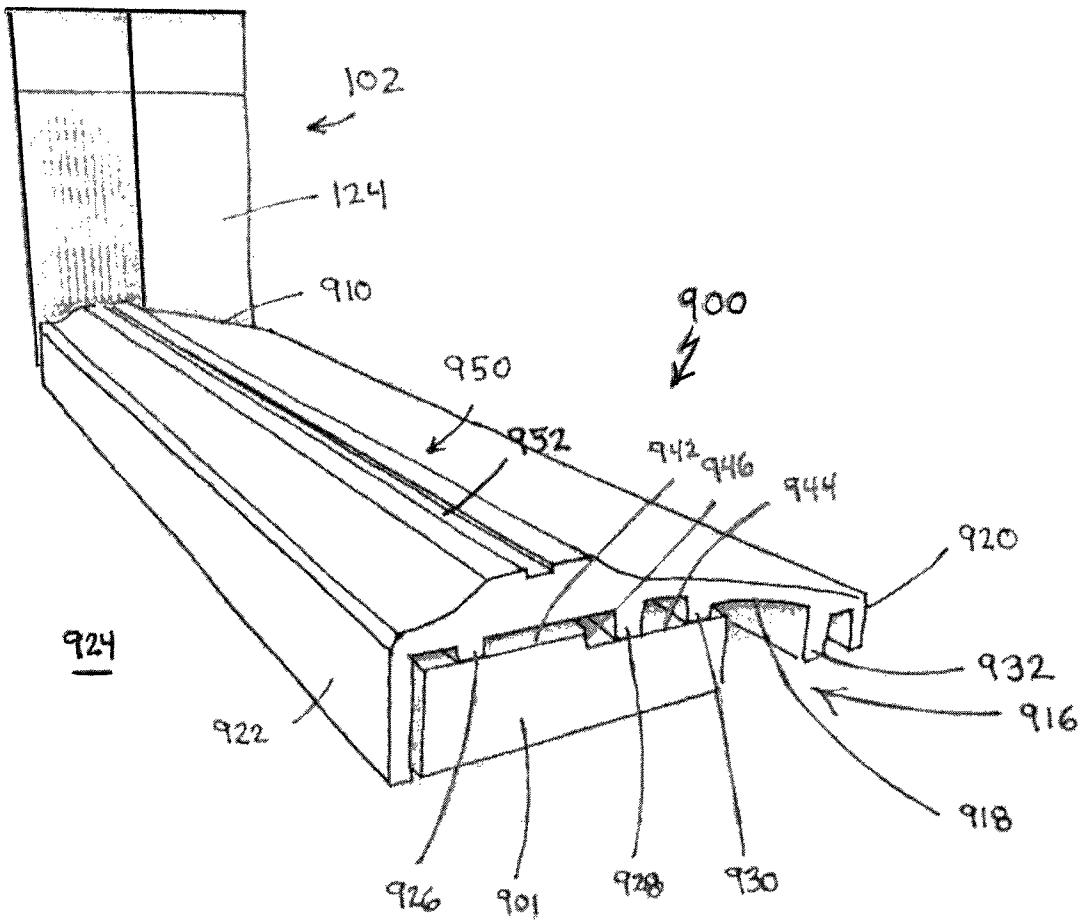
FIG. 27 is a sectioned partial perspective view of an exemplary embodiment of a sill section for use with another embodiment of a cross member.

FIG. 27 illustrates an exemplary embodiment of a sill section 900 that is configured to at least partially fit over top of and at least partially cover a cross member 901. The sill section 900 may be installed later in the construction process, for example, after the door frame 102 with an optional cross member 901 has been installed. The sill section 900 and the cross member 901 are similar to the sill section 700 and the cross member 901 of FIG. 26.

In particular, the sill section 900 includes a first end 910 and a second end (not shown) spaced apart from the first end. The sill section 900 has an top side 912 having an upper surface 914, a bottom side 916 having a lower surface 918, a first edge 920 extending between the top side 912 and the bottom side 916, and a second edge 922 opposite the first edge 920 and extending between the top side 912 and the bottom side 916. The first edge 920 and the second edge 922 extend downward from the lower surface 918 to engage a floor 924 or other surface.

The bottom side 916 of the sill section 900 is configured to receive the cross member 901 in a recess 925. The sill section 900 differs from the sill section 800 of FIG. 26 in that the bottom side 916 includes four longitudinal ribs instead of the six longitudinal ribs of the sill section 800. In particular, the sill section 900 includes a first longitudinal rib 926, a second longitudinal rib 930, a third longitudinal rib 932, and a fourth longitudinal rib 934. In the illustrated embodiment of FIG. 27, the first longitudinal rib 926 is shorter than the second and third longitudinal ribs 928, 930 and the fourth longitudinal rib 932 is shorter than the second and third longitudinal ribs 928, 930. The difference in the height of the longitudinal ribs 926-932 is a result of the cross member 901 having an upper surface 940 that differs from the upper surface of the cross member 700. In particular, the upper surface 940 is stepped having a first upper surface 942 separated from a second upper surface 944 by a shoulder 946.

The first, second and third ribs 926-930 are sized such that the cross member 901 can be received in the recess 925 and the sill section 900 covers, or at least partially covers, the cross member 901. In the exemplary embodiment, the first rib 926 engages the first upper surface 942 and the second and third ribs 928, 930 engage the second upper surface 944 while the fourth rib 932, the first edge 920, and the second edge 922 engage the floor 924.

The sill section 900 can be attached to the door frame 102 in any suitable manner. For example, the sill section 900 may be attached to the first side section 124 and the second side section 126 (not shown in FIG. 26) and/or to the cross member 901 by fasteners, adhesive, or other suitable means. The recess 925 may also be sized to provide a friction fit with the cross member 901 to hold the sill section 900 onto the cross member 901.

The top surface 914 of the sill section 900 may be configured in any suitable manner for use as a sill in a door frame 102. In the exemplary embodiment, the top surface includes a raised portion 950 defining a longitudinal groove 952. The groove 952 may be configured to mount a seal (not shown) on the sill section 900.

Figure 28:
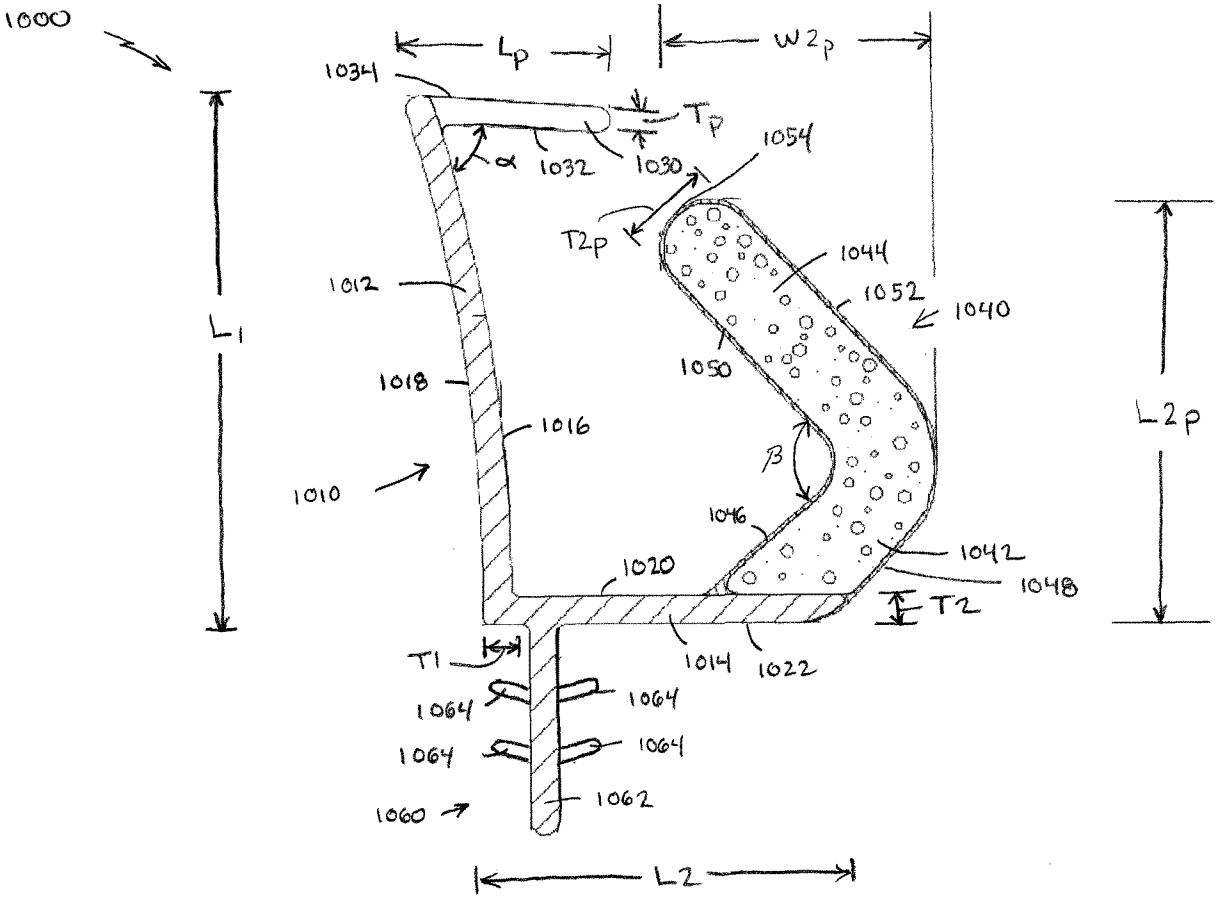
FIG. 28 is a cross section view of an exemplary embodiment of a seal for use with a door assembly.
Figure 30:
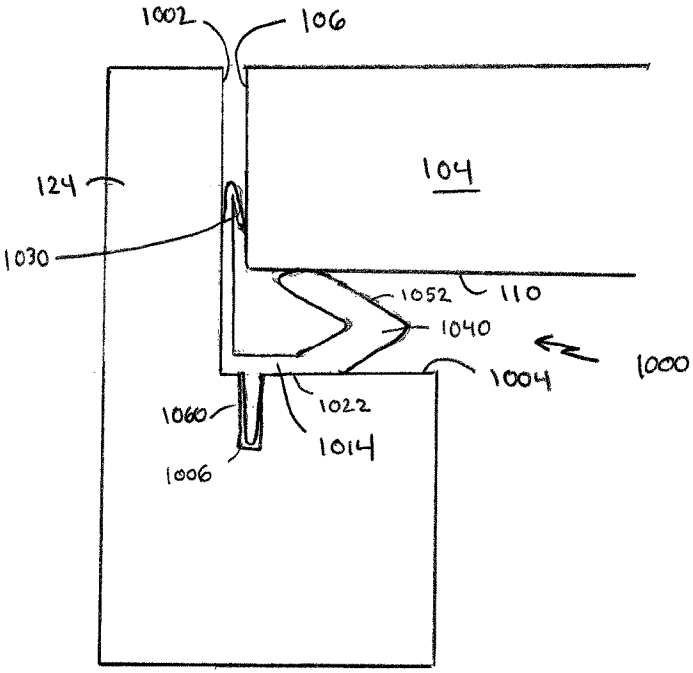
FIG. 30 is a cross section view of the seal of FIG. 28 installed on a door frame with a door in a closed position.
Figure 29:
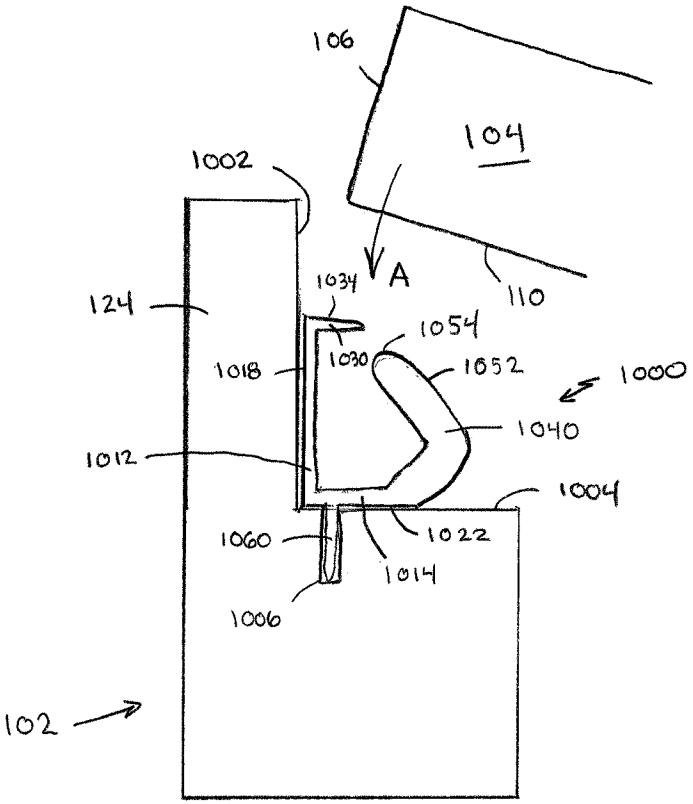
FIG. 29 is a cross section view of the seal of FIG. 28 installed on a door frame with a door in an open position.

FIGS. 28-30 illustrates an exemplary embodiment of a seal 1000 for use with the door assembly 100 (FIG. 1). The seal may be configured in a variety of ways and located in a variety of locations. Referring to FIG. 1, the seal 1000 may be positioned between at least a portion of the door 104 and the door frame 102 when the door is in the closed position to provide a seal between the door 104 and the door frame 102. In one exemplary embodiment, the seal 1000 is mounted on one of the first edge surface 106 of the door 104 or on the first side section 124 of the door frame 102 such that the seal 1000 provides a seal between the first edge surface 106 and the first side section 124 when the door 104 is closed. The seal 1000 may extend along the entire height of first side section 124 or the first edge surface 106 or a portion of the height.

In the exemplary embodiment of FIGS. 28-30, the seal 1000 is mounted onto the first side section 124 of the door frame 102. The first side section 124 includes a first side face 1002 arranged to be parallel to, or substantially parallel to the first edge surface 106 of the door 104 when the door is in a closed position and a shoulder 1004 extending generally parallel to the first side face 1002. In the exemplary embodiment, the seal 1000 may mount onto the shoulder 1004 of the first side section 124 via a kerf-style connection. The shoulder 1004, therefore, may include one or more grooves 1006 for receiving a corresponding connector on the seal 1000 or the seal may include one or more grooves for receiving a corresponding connector on the shoulder. In other embodiments, however, the seal 1000 may mount to other portions of the first side section 124.

Referring to FIG. 28, the seal 1000 may have an L-shaped, or generally L-shaped body 1010 including a first leg 1012 and a second leg 1014 extending perpendicular to, or generally perpendicular to, the first leg. The first leg 1012 has an inner surface 1016, an outer surface 1018, a thickness T1, and a length L1. The second leg 1014 has an inner surface 1020, an outer surface 1022, a thickness T2, and a length L2.

The seal 1000 includes a first elastic or bendable projection 1030 extending from the inner surface 1016 of the first leg 1012. The first projection 1030 may be configured in a variety of ways. Any structure than can be elastically deformed by the door 104 to form a seal between the first leg 1012 and the first edge surface 106 of the door 104 when the door is in the closed position may be use.

In the exemplary embodiment, the first projection 1030 is generally planar and extends at an angle α from the inner surface 1016 in the range of about 50 degrees to about 90 degrees. In some embodiments the angle α is in the range of about 60 degrees to about 80 degrees, in the range of about 65 degrees to about 75 degrees, or about 70 degrees. In other embodiments, however, the shape of the first projection 1030 may be other than planar and the angle α may be less than 50 degrees or greater than 90 degrees.

The first projection 1030 has an inner surface 1032 that generally faces the inner surface 1020 of the second leg 1012, an outer surface 1034 opposite the inner surface 1032, a thickness Tp, and a length Lp. In the exemplary embodiment, the first projection thickness Tp is equal to, or generally equal to, the first leg thickness T1. In other embodiments, however, the first projection thickness Tp may be thicker or thinner than the first leg thickness T1. The thickness Tp of the projection 1030 may change over the length Lp of the projection. For example, the projection 1030 may be tapered such that the thickness Tp of the projection is thicker adjacent the inner surface 1016 and thinner at the distal end of the projection.

In the exemplary embodiment, the first projection length Lp is less than the first leg length L1. In some embodiments, the first projection length Lp is less than 50% of the first leg length L1 or is less than 40% of the first leg length L1. In other embodiments, however, the first projection length Lp may be greater than 50% of the first leg length L1.

In the exemplary embodiment, the seal 1000 includes a second elastic or bendable projection 1040 extending from the inner surface 1020 of the second leg. The second projection 1040 may be configured in a variety of ways. Any structure than can be elastically deformed by the door 104 to form a seal between the shoulder 1004 and the first face surface 110 of the door 104 when the door is in the closed position may be use.

In the exemplary embodiment, the second projection 1040 is generally L-shaped or curved and includes a proximate portion 1042 and a distal portion 1044. The distal portion 1044 is connected to the proximate portion 1042 at an angle β. In the some embodiments, the angle β is in the range of about 60 degrees to about 110 degrees, in the range of about 75 degrees to about 100 degrees, or about 90 degrees. In other embodiments, the angle β may be greater 110 degrees or less than 60 degrees.

The proximate portion 1042 has an inner surface 1046 and an outer surface 1048 opposite the inner surface 1046. The distal portion 1044 has an inner surface 1050, an outer surface 1052 opposite the inner surface 1050, and a terminal end 1054. The second projection has a width W2*p*, and a length L2*p*. In one exemplary embodiment, the width W2*p* is less than the length L2*p*. In some embodiments, the width W2*p* less than 80% of the length L2*p* or less than 70% of the length L2*p*.

The second projection 1040 has a thickness T2*p*. In one exemplary embodiment, the second projection thickness T2*p* is greater that the first projection thickness Tp. In some embodiments, the second projection thickness T2*p* is greater than 2× the first projection thickness Tp or greater than 3× the first projection thickness.

The seal 1000 may include structure to facilitate attaching the seal to the door frame 102 or the door 104. The structure to facilitate attaching the seal 1000 to the door frame 102 or the door 104 may be configured in a variety of ways. In the exemplary embodiment, the seal 1000 includes a connector 1060 for attaching the seal 1000 to the shoulder 1004 of the first side section 124. In one embodiment, the seal 1000 attaches to the first side section 124 by a kerf-style connection and the connector 1060 is configured to be received in the groove 1006 in the shoulder 1004. The connector 1060 may be configured in a variety of ways. Any connector 1060 capable of engaging the groove to hold the seal onto the first side section 124 may be used. In the exemplary embodiment, the connector 1060 is a "Christmas tree" style connector having a main stem portion 1062 extending from the outer surface 1022 of the second leg 1014 and a plurality of branches 1064 extending outward from the main stem portion 1062 and angled toward the outer surface 1022 of the second leg 1014. The branches 1064 are designed to fold inward when the connector 1060 is inserted in the groove 1006 and to resist withdrawal of the connector 1060 from the groove 1006.

The seal 1006 may be made from a variety of materials. In some embodiments, the seal may be made from a single material. In other embodiments, however, the seal 1006 may be made from more than one material. For example, any of seal portions including the L-shaped body 1010, the first projection 1030, the second projection 1040, and the connector 1060 may be made of a material that is different from any of the other portions. In one exemplary embodiment, for example. the first projection 1030 and the second projection 1040 are made of a different material than the L-shaped body 1010 and the connector. Suitable materials for the seal may include, but not be limited to, expanded EPDM (methylene propylene diene monomer) rubber, silicone sponge, urethane, silicone, neoprene, butyl, or other suitable materials.

Referring to FIGS. 29 and 30, the seal 1000 is mounted in the door frame 102 such that the connector 1060 is received with the groove 1006, the outer surface 1018 of the first leg 1012 is adjacent the first side face 1002 of the first side section 124 and the outer surface 1022 of the second leg 1014 is adjacent the shoulder 1004. In this position, the outer surface 1034 of the first projection 1030 generally faces the first face surface 110 of door 104 as the door closes, as shown by the arrow A in FIG. 28.

When the door 104 moves from the open position (FIG. 29) to the closed position, (FIG. 30), the first face surface 110 of the door 104 contacts the outer surface 1034 of the first projection 1030. As the door 104 continues to close, the first projection 1030 is bent, deflected, or deformed downward (i.e. clockwise in FIGS. 29 and 30). As the first projection 1030 is deflected, the angle α decreases as the inner surface 1032 of the first projection 1030 approaches the inner surface 1016 of the first leg 1012.

As the door 104 continues to close, the bent first projection 1030 moves from contacting the first face surface 110 of the door 104 to contacting the first edge surface 106 of the door 104, as shown in FIG. 30. Continued closing movement of the door 104 results in the first face surface 110 engaging the second projection 1040 at the terminal end 1054 and/or the outer surface 1052 of the distal portion 1044 of the second projection 1040. As the door continues to close, the second projection 1040 bends at the intersection between the proximate portion 1042 and the distal portion 1044. As the second projection 1040 bends, the angle β decreases as the inner surface 1050 of the distal portion 1044 approaches the inner surface 1046 of the proximate portion 1042.

In the closed position, as shown in FIG. 30, first projection 1030 is bent over toward the first leg 1012, and in some embodiments, may be contacting the first leg. The first leg 1012 and bent first projection 1030 form a seal between the first edge surface 106 of the door 104 and the first side face 1002 of the door frame 102. Likewise, distal portion 1044 of the second projection 1040 is bent over toward the proximate portion 1042 to form a seal between the first face surface 110 of the door and the shoulder 1004.

Any of the features and inventive concepts disclosed in US 2016/0208546 may be used with any of the features and inventive concepts disclosed in the preceding paragraphs.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to any particular door assembly application. Furthermore, although various embodiments are described in detail, in view of the accompanying drawings, those skilled in the art will understand that aspects and elements of one exemplary embodiment can be used or modified for use with other embodiments and should not be construed as limited to the embodiments set forth herein. It is sought, therefore, to cover all such changes and modifications as fall within the spirit and scope of the general inventive concepts, as described and claimed herein, and equivalents thereof.

What is claimed is:

1. A door assembly, comprising:

a door frame including a first side section, a second side section, and a sill section;

a door pivotably connected to the door frame by a hinge such that the door is pivotable between an open position and a closed position, the door including a first edge surface and a second edge surface, wherein the second edge surface faces the sill section;

wherein the door further comprises a first rounded corner between the first edge surface and the second edge surface and the door frame further comprises a second rounded corner between the first side section and the sill section;

wherein a door seal is attached to the door along the first edge surface, the rounded corner, and the second edge surface and a frame seal is attached to the door frame along the first side section, the rounded corner, and the sill section;

wherein the door seal includes a first flat surface facing the door, and a first convex curved surface facing away from the door, the first convex curved surface including a first substantially flat and sloped surface, and a first rounded surface joined with the first sloped surface at an apex of the first convex curved surface, and the frame seal includes a second flat surface facing the door frame, and a second convex curved surface facing away from the door frame, the second convex curved surface including a second substantially flat and sloped surface, and a second rounded surface joined with the second sloped surface at an apex of the first convex curved surface, connecting the second flat surface to the second sloped surface; and wherein, the first sloped surface engages the second sloped surface when the door is in the closed position.

2. The door assembly of claim 1 wherein the door seal has a side profile in a shape of a bisected tear drop.

3. The door assembly of claim 1 wherein the door seal includes a pair of spaced apart projections extending outward from the flat first surface, and the door includes a pair of spaced apart channels along the second edge surface, wherein the pair of projections are received into the channels to attach the door seal to the door.

4. The door assembly of claim 1 wherein the frame seal has a side profile in a shape of a bisected tear drop.

5. The door assembly of claim 1 wherein the frame seal includes a pair of spaced apart projections extending outward from the second flat surface, and wherein the sill section includes a pair of spaced apart channels that receive the pair of projections to attach the frame seal to the sill section.

6. The door assembly of claim 1 wherein the hinge includes a first portion connected to the second side section and a second portion connected to the first edge surface to pivotably connect the door to the door frame such that the door is pivotable between the open position and the closed position, wherein the hinge moves the second edge surface vertically downward toward the sill section only during about the last 50 degrees of pivotal movement of the door from the open position to the closed position.

7. The door assembly of claim 6 wherein the hinge moves the second edge surface vertically downward toward the sill section only during about the last 40 degrees of pivotal movement of the door from the open position to the closed position.

8. The door assembly of claim 6 wherein the hinge moves the second edge surface vertically downward toward the sill section only during about the last 10 degrees of pivotal movement of the door from the open position to the closed position.

9. The door assembly of claim 6 wherein the hinge further comprises a door side knuckle portion having a flat engagement surface and a ramped engagement surface; and a frame side knuckle portion having a flat engagement surface and a ramped engagement surface, wherein the hinge moves the second edge surface vertically downward toward the sill section when the ramped engagement surfaces are in contact.

10. The door assembly of claim 1, wherein when the door is in the closed position, the first sloped surface and the second sloped surface define an overlap region in which the door seal and the frame seal conform to each other to improve sealing.

* * * * *